US007815439B2

(12) United States Patent
Klein et al.

(10) Patent No.: US 7,815,439 B2
(45) Date of Patent: Oct. 19, 2010

(54) INSULATION DISPLACEMENT PLUG-IN CONNECTOR AND DEVICE FOR TELECOMMUNICATIONS AND DATA TECHNOLOGY

(75) Inventors: Harald Klein, Berlin (DE); Dominic Joseph Louwagie, Eden Prairie, MN (US); Manfred Müller, Berlin (DE)

(73) Assignee: ADC GmbH, Berlin (DE)

( * ) Notice: Subject to any disclaimer, the term of this patent is extended or adjusted under 35 U.S.C. 154(b) by 29 days.

(21) Appl. No.: 11/996,177

(22) PCT Filed: Jul. 17, 2006

(86) PCT No.: PCT/EP2006/007020

§ 371 (c)(1),
(2), (4) Date: Jan. 18, 2008

(87) PCT Pub. No.: WO2007/009729

PCT Pub. Date: Feb. 25, 2007

(65) Prior Publication Data

US 2008/0227329 A1 Sep. 18, 2008

(30) Foreign Application Priority Data

Jul. 21, 2005 (DE) ..... 10 2005 033 998

(51) Int. Cl.
*H01R 12/00* (2006.01)

(52) U.S. Cl. ..... 439/66

(58) Field of Classification Search ..... 439/66, 439/82, 395, 80, 83, 405, 668, 669, 76.1
See application file for complete search history.

(56) References Cited

U.S. PATENT DOCUMENTS

| | | | | |
|---|---|---|---|---|
| 3,990,767 | A | | 11/1976 | Narozny |
| 4,143,935 | A | | 3/1979 | Goodman et al. |
| 4,190,952 | A | | 3/1980 | Thomas et al. |
| 4,279,460 | A | | 7/1981 | Forberg |
| 4,460,228 | A | | 7/1984 | Lane et al. |
| 4,464,002 | A | | 8/1984 | Suzuki et al. |
| 4,538,873 | A | | 9/1985 | Worth |
| 5,494,461 | A | | 2/1996 | Bippus et al. |
| 5,520,550 | A | | 5/1996 | Okabe |
| 5,772,472 | A | | 6/1998 | Beutler et al. |
| 5,997,358 | A | | 12/1999 | Adriaenssens et al. |
| 6,017,239 | A | * | 1/2000 | Watanabe et al. ..... 439/405 |
| 6,106,308 | A | * | 8/2000 | Chen et al. ..... 439/79 |
| 6,116,961 | A | | 9/2000 | Henneberger et al. |
| 6,325,657 | B1 | | 12/2001 | Schroer |
| 6,371,793 | B1 | | 4/2002 | Doorhy et al. |

(Continued)

FOREIGN PATENT DOCUMENTS

| | | |
|---|---|---|
| CN | 1245985 | 3/2000 |

(Continued)

*Primary Examiner*—T C Patel
*Assistant Examiner*—Phuong Nguyen
(74) *Attorney, Agent, or Firm*—Merchant & Gould P.C.

(57) ABSTRACT

The invention relates to an insulation displacement plug-in connector for telecommunications and data technology, comprising a housing (45) and a number of contact elements (43), wherein the contact elements (43) each comprise an insulation displacement contact (54) for connecting cores and a pin contact (53) for making contact with a printed circuit board, wherein at least one extension (55) is arranged between the insulation displacement contact (54) and the pin contact (53).

13 Claims, 13 Drawing Sheets

U.S. PATENT DOCUMENTS

| | | | | |
|---|---|---|---|---|
| 6,379,198 | B1 | 4/2002 | Arnett et al. | |
| 6,511,330 | B1 * | 1/2003 | Norris | 439/76.1 |
| 6,612,880 | B2 | 9/2003 | Arnett et al. | |
| 6,626,705 | B2 | 9/2003 | Perrone et al. | |
| RE38,519 | E * | 5/2004 | Doorhy et al. | 439/404 |
| 6,840,815 | B2 | 1/2005 | Musolf et al. | |
| 6,890,187 | B2 | 5/2005 | Norris | |
| 6,918,793 | B2 | 7/2005 | Baker et al. | |
| 7,195,521 | B2 | 3/2007 | Musolf et al. | |
| 2003/0064611 | A1 * | 4/2003 | Musolf et al. | 439/43 |
| 2007/0111555 | A1 | 5/2007 | Neumetzler | |

FOREIGN PATENT DOCUMENTS

| | | |
|---|---|---|
| CN | 1559148 | 2/2004 |
| DE | 43 32 534 | 3/1995 |
| DE | 199 42 712 | 3/2000 |
| DE | 103 33 913 | 2/2005 |
| EP | 0 043 183 | 1/1982 |
| EP | 0 637 097 | 2/1995 |
| EP | 0 766 352 | 4/1997 |
| EP | 0 982 815 | 3/2000 |
| EP | 0 991 151 | 4/2000 |
| GB | 2 090 481 | 7/1982 |

* cited by examiner

FIG.2c
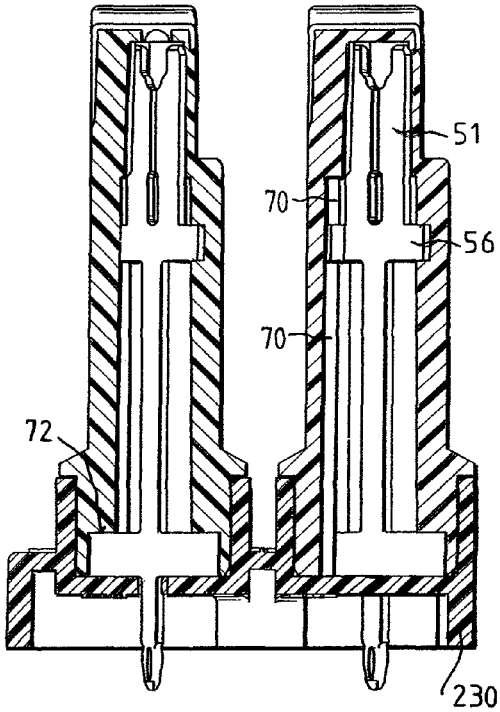
FIG.2d
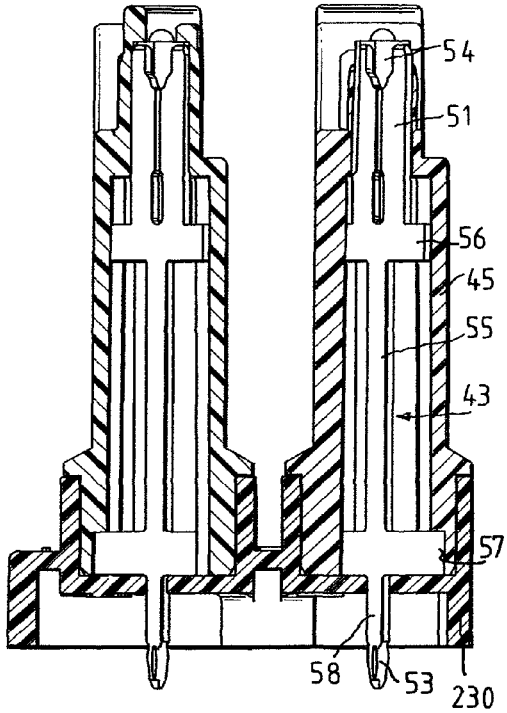
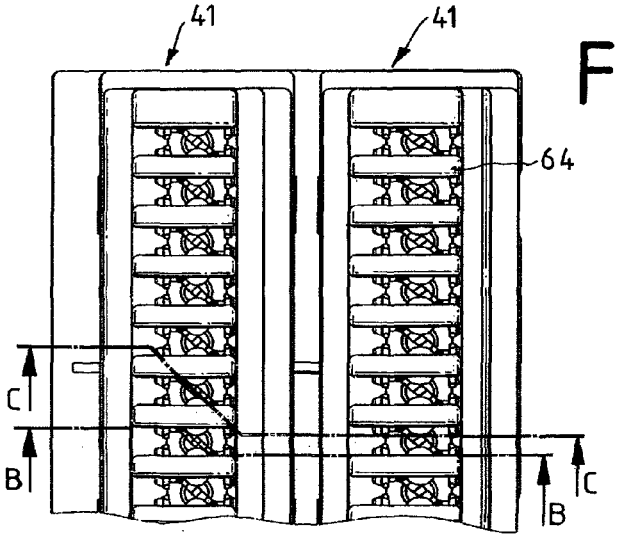
FIG.2b

INSULATION DISPLACEMENT PLUG-IN CONNECTOR AND DEVICE FOR TELECOMMUNICATIONS AND DATA TECHNOLOGY

The invention relates to an insulation displacement plug-in connector and to a device for telecommunications and data technology.

An insulation displacement plug-in connector such as this is known, for example, from EP 0 766 352 B1. The insulation displacement plug-in connector has a housing in which contact elements are arranged, with the contact elements having a first contact area which is in the form of an insulation displacement contact, and having a second contact area, which is in the form of a contact pin (pin contact) which can be soldered. The housing is integral and is soldered to the printed printed circuit board via the contact pins. The contact elements are inserted from the upper side of the housing and are held by stops, with the contact pins projecting out of the underside of the housing in the inserted state. Shielding plates are provided for shielding, which are inserted from the underside of the housing and are each arranged between two pairs of contact elements. The shielding plates likewise have contact pins, so that these can likewise be soldered to the printed circuit board and can be connected to a common ground line. Modules such as these are referred to as PCB modules. Wires can then be electrically connected to the printed circuit board via the contact areas in the form of insulation displacement contacts.

A digital signal distributor DSX (Digital Cross-Connect System) provides a jumper connection between two digital transmission paths. The DSX apparatus is usually located in frames which are usually arranged in a telephone service provider's central office. The DSX apparatus also provides a socket access to the transmission paths.

DSX sockets are well known and typically include a plurality of bores sized for receiving plugs. A plurality of switches is provided within the bores for contacting the plugs. The sockets are electrically connected to digital transmission lines, and are also electrically connected to a plurality of termination members used to cross-connect the sockets. By inserting plugs within the bores of the sockets, signals transmitted through the sockets can be interrupted or monitored.

FIG. 1 schematically illustrates a DSX system already known from U.S. Pat. No. 6,840,815 that is an example of a system found at a telephone service provider's digital central office. The DSX system is shown including three DSX sockets 10*a*, 10*b* and 10*c*. Each DSX socket 10*a*, 10*b* and 10*c* is connected to a specific part of the digital device. For example, DSX socket 10*a* is connected to digital switch 12, DSX socket 10*b* is connected to office repeater 14*a*, and DSX socket 10*c* is connected to office repeater 14*b*. Each piece of the digital device has an input at which a digital signal can enter, as well as an output at which the digital signal can exit. The DSX sockets 10*a*, 10*b* and 10*c* each include for this purpose OUT termination pins 16 and IN termination pins 18. The DSX sockets 10*a*, 10*b* and 10*c* are connected to their corresponding pieces of the digital device by connecting the OUT termination pins 16 to the signals exiting the device (i.e., going toward the DSX system) and by connecting the IN termination pins 18 to the signals entering the device (i.e., going away from the DSX system).

Referring still to FIG. 1, DSX sockets 10*a* and 10*b* are "cross-connected" to one another by semi-permanent connections. The semi-permanent connections extend between cross-connect fields 19 of the DSX sockets 10*a* and 10*b*. For example, patch cords 20 connect OUT cross-connect pins of DSX socket 10*a* to IN cross-connect pins of DSX socket 10*b*. Similarly, patch cords 21 connect IN cross-connect pins of DSX socket 10*a* to OUT cross-connect pins of DSX socket 10*b*. The switches of the DSX sockets 10*a* and 10*b* are preferably closed. Thus, in the absence of a plug inserted within either of the DSX sockets 10*a* and 10*b*, a connection is provided between the DSX sockets 10*a* and 10*b* and therefore between digital switch 12 and office repeater 14*a*.

The semi-permanent connection between the digital switch 12 and the office repeater 14*a* can be interrupted for diagnostic purposes by inserting plugs within the IN or OUT ports of the DSX sockets 10*a* and lob. Likewise, patch cords can be used to interrupt the semi-permanent connection between the DSX sockets 10*a* and 10*b* to provide connections with other pieces of the digital device. For example, the digital switch 12 can be disconnected from the office repeater 14*a* and connected to the office repeater 14*b* through the use of patch cords 23. The patch cords 23 include plugs that are inserted within the IN and OUT ports of the DSX socket 10*a* and the IN and OUT ports of the DSX socket 10*c*. By inserting the plugs within the IN and OUT ports of the DSX socket 10*a*, the normally closed switches or contacts are opened, thereby breaking the electrical connection with the office repeater 14*a* and making an electrical connection with the office repeater 14*b*.

U.S. Pat. Nos. 6,116,961 and 6,840,815 B2 each disclose a digital signal distributor of modular construction. The modules each have a socket receptacle for holding four DSX sockets, as well as a printed circuit board. The socket receptacle is connected to the printed circuit board via first contact elements, with parts of the contact elements projecting through openings in the socket receptacle and making contact with the DSX sockets when they are inserted. The printed circuit board is longer than the socket receptacle, so that cross-connect and device termination fields can be arranged underneath the socket receptacle. For this purpose, a cover part is fitted to the printed circuit board, at least from the socket receptacle side. The cover part has openings into which contact elements can be inserted. The contact elements have a pin contact for making contact with the printed circuit board, and have a wire-wrap contact for connection of wires. Furthermore, both documents disclose the use of insulation displacement contacts instead of the wire-wrap contacts.

One problem in using insulation displacement contacts as a substitute for wire-wrap contacts is that they require more space. This is because the insulation displacement contacts must be connected using a special tool, and this requires free accessibility.

Therefore, the invention is based on the technical problem of providing an insulation displacement plug-in connector as well as device equipped with such a connector for telecommunications and data technology, which makes possible a compact configuration.

For this purpose, an extension is arranged between the insulation displacement contact and the pin contact. This means that the insulation displacement contacts are moved away from the printed circuit board. However, this dimension is normally not critical for the packing density. The extension is in this case chosen such that the insulation displacement fitting tool is not impeded by peripheral edges during connection. A high contact density is thus maintained, and the known advantages of insulation displacement technology are made use of. In this case, insulation displacement contacts, extensions and pin contacts are preferably integral.

In one preferred embodiment, a guide element is arranged on the underside of the insulation displacement contact and is also preferably broader than the insulation displacement contact. One possible embodiment is in the form of a rectangle. The guide element considerably improves the insertion of the insulation displacement contacts into the housing, since the extension increases the elasticity of the contact element.

In a further preferred embodiment, two curved elements are arranged at the end of the extension associated with the pin contact. These are preferably arranged symmetrically around the extension, with the two curves preferably also being in opposite senses to one another. The curved elements are used on the one hand to support the contact element, in order to absorb the connection forces which occur. The curved configuration also allows the design to be chosen to be very compact.

In a further preferred embodiment, the insides of the housing are designed with grooves for the guide elements, which extend from the underside of the housing to the upper side. In this context, the expression to the upper side should be understood as meaning that the groove extends to such an extent that parts of the insulation displacement contact are still located in the groove.

In a further preferred embodiment, slots are incorporated in the groove walls of the guide elements, with the length of the slots corresponding to the length of the elements of the curved elements.

In a further preferred embodiment, a further extension is arranged between the curved elements and the pin contact. This extension in this case corresponds to the thickness of a cover piece which is arranged on the printed circuit board.

In a further preferred embodiment, latching tabs are arranged on the outsides of the housing. These latching tabs can be used to latch the insulation displacement plug-in connector to the cover piece, thus resulting in it being more robust. For this purpose, the cover piece has a receptacle for the insulation displacement plug-in connector. The receptacle preferably has walls which define an open cube, with the walls having latching openings for the latching tabs.

In a further preferred embodiment, the housing of the insulation displacement plug-in connector has slots for holding the wires to be connected, with the insulation displacement contact being aligned at an angle of 45° to the slot. In consequence, reliable contact is made with the wire, with the diameter of the wire being reduced only slightly by the clamping process.

One preferred field of application for the insulation displacement plug-in connector according to the invention is use in a digital signal distributor.

The invention will be explained in more detail below on the basis of a preferred exemplary embodiment. In the figures.

Figure 1:
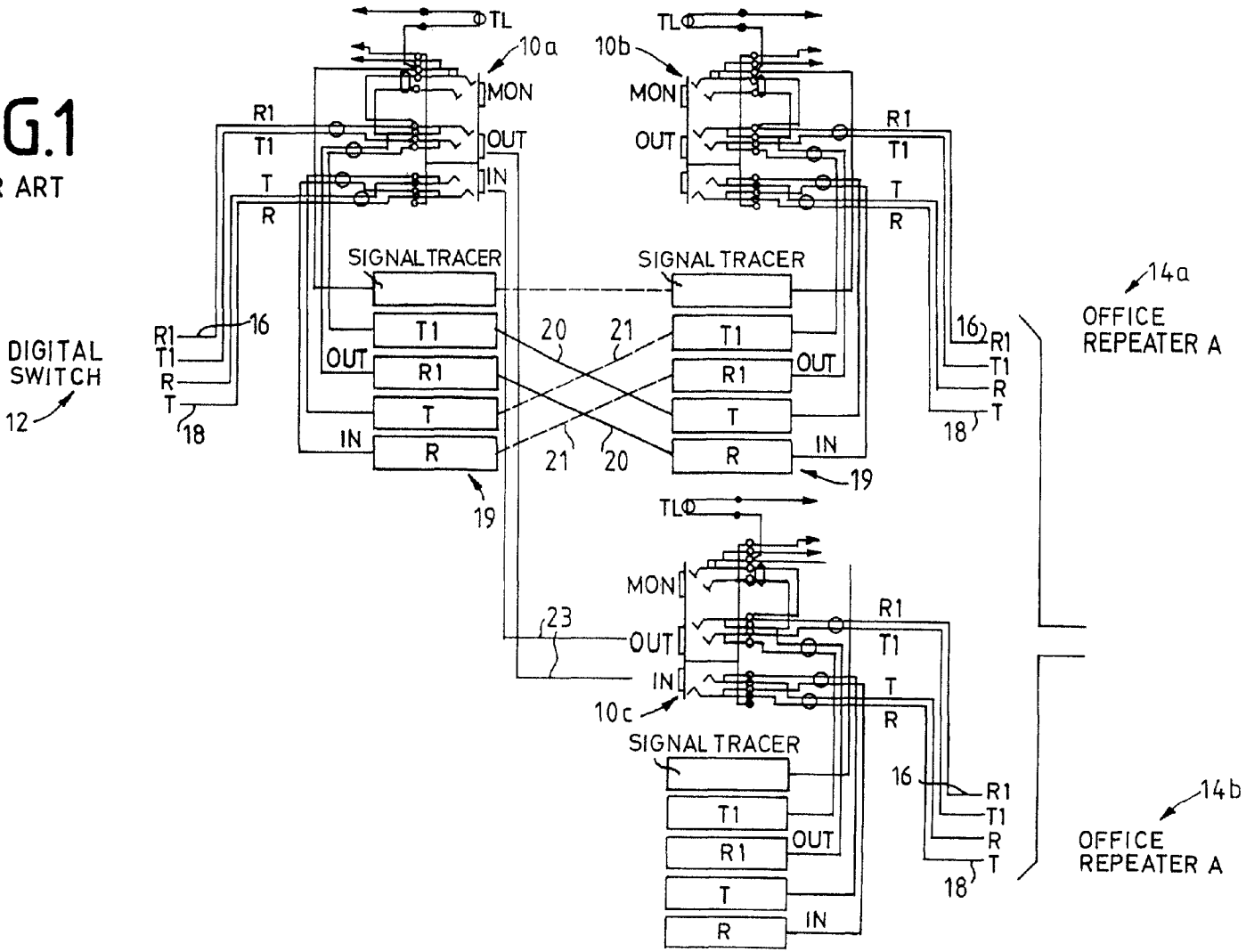
FIG.1 PRIOR ART
FIG. 1 is a schematic diagram of a prior art DSX system.
Figure 2:
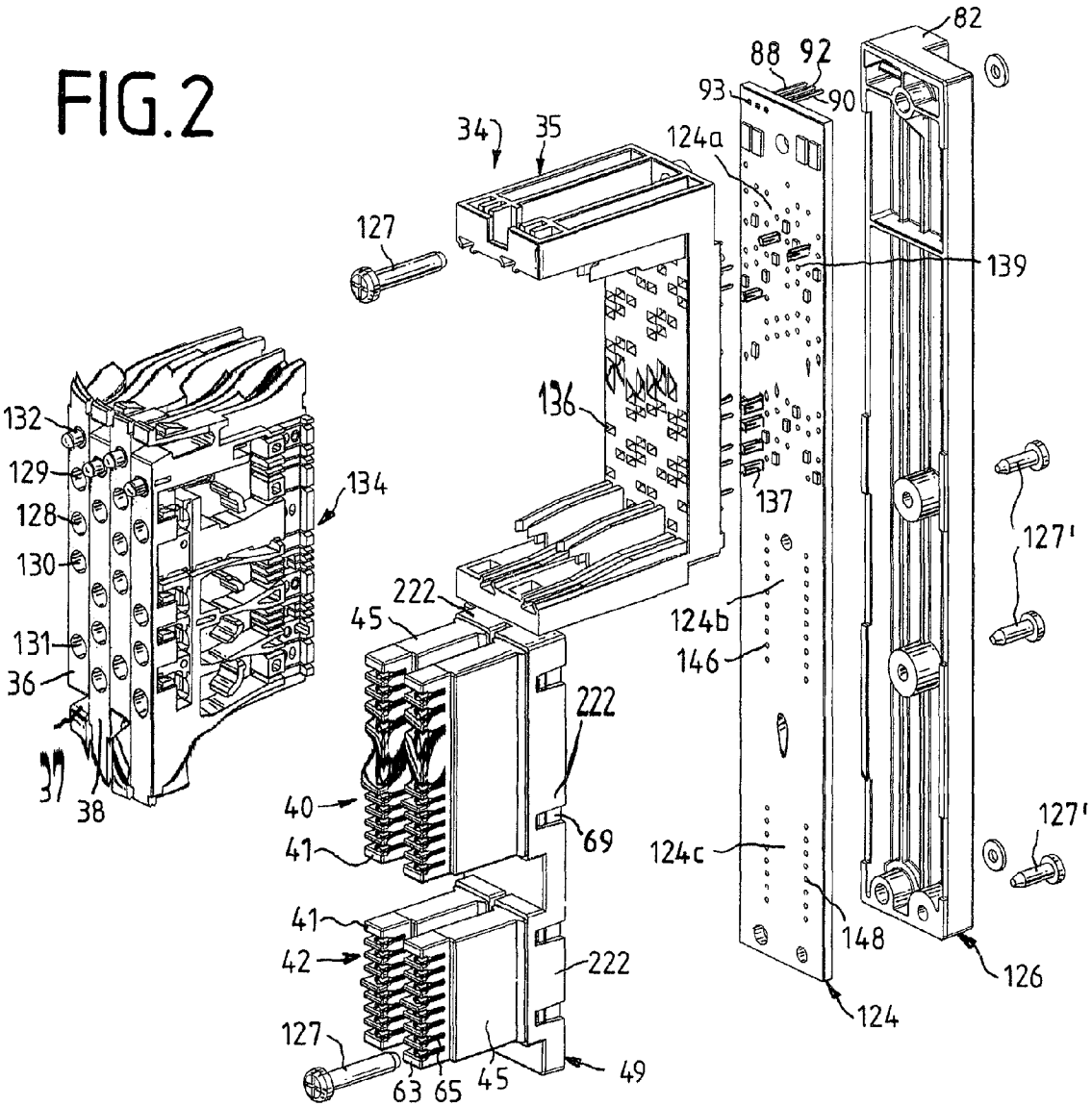
FIG. 2 is an exploded, front perspective view of a first embodiment of a DSX module.
Figure 2A:
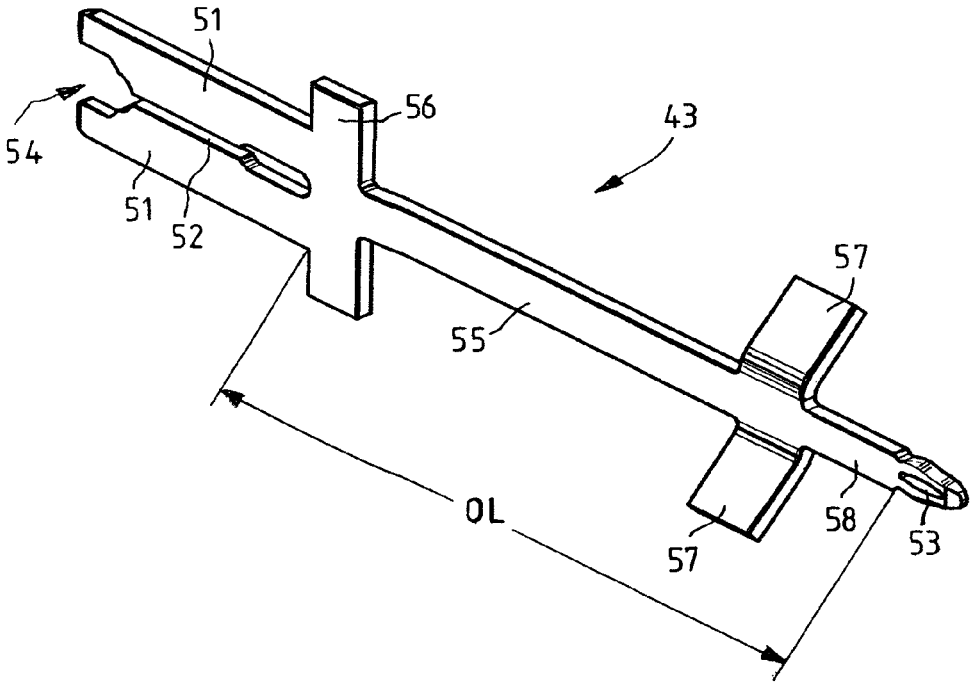
Figure 3:
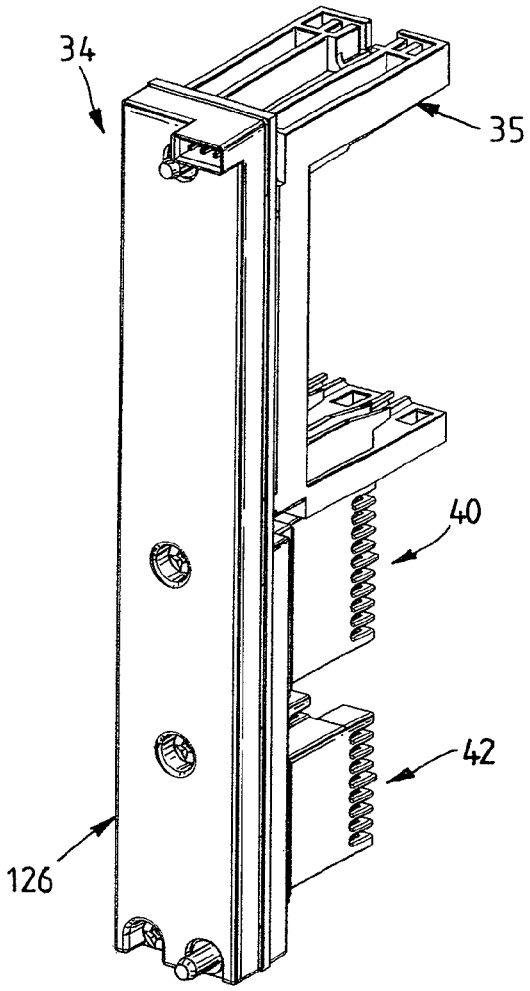
Figure 4:
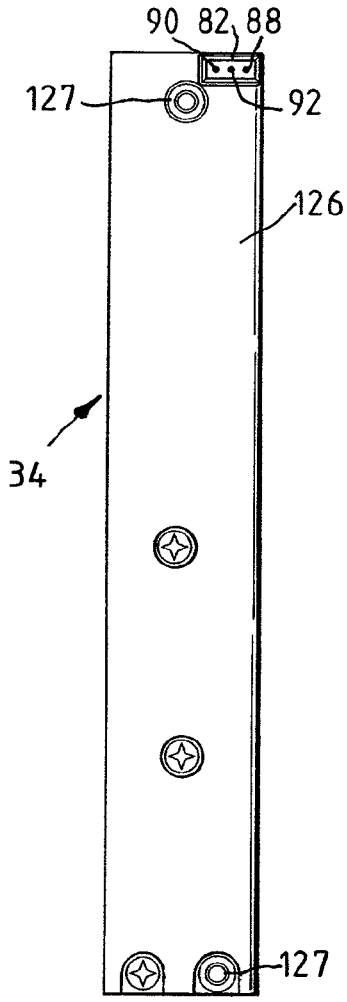
Figure 5:
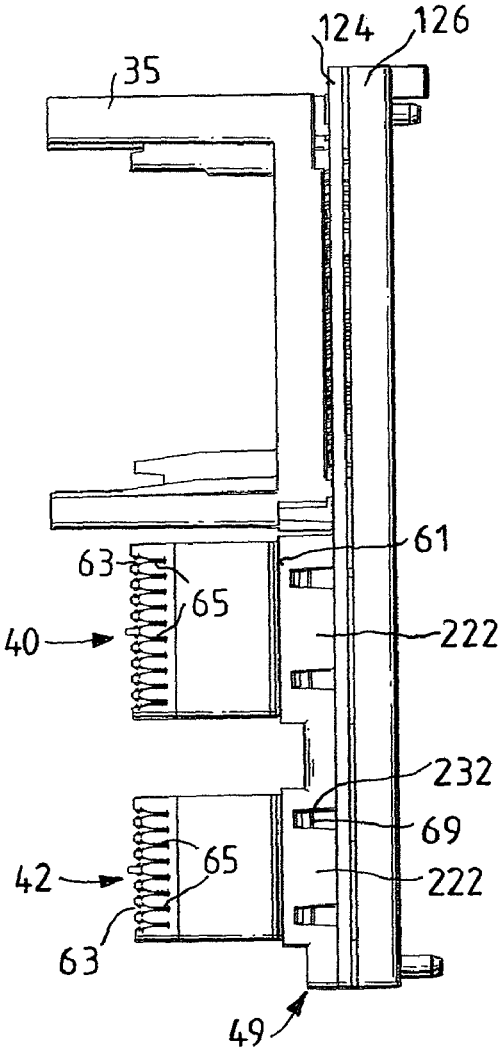
Figure 6:
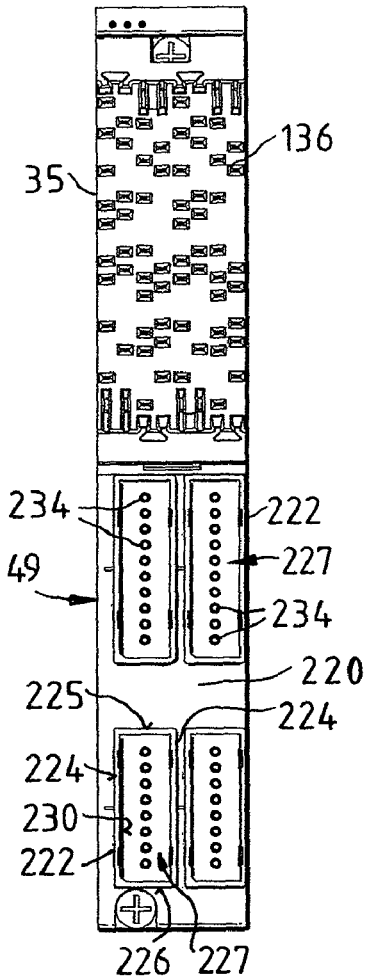
Figure 7:
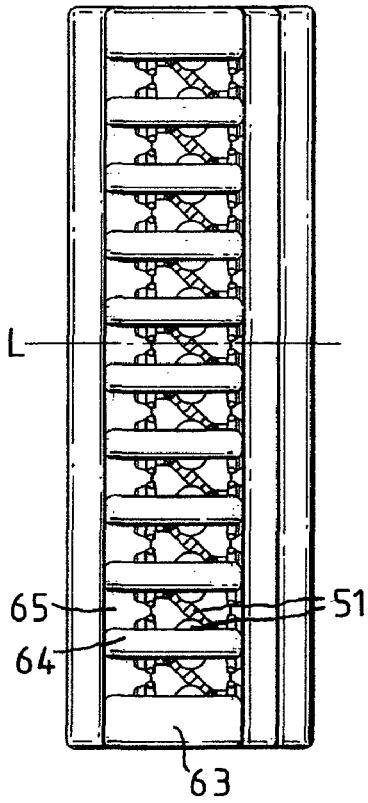
Figure 8:
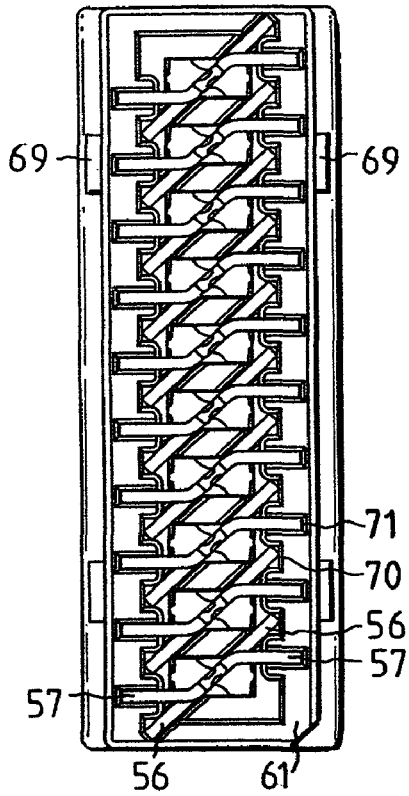
Figure 9A:
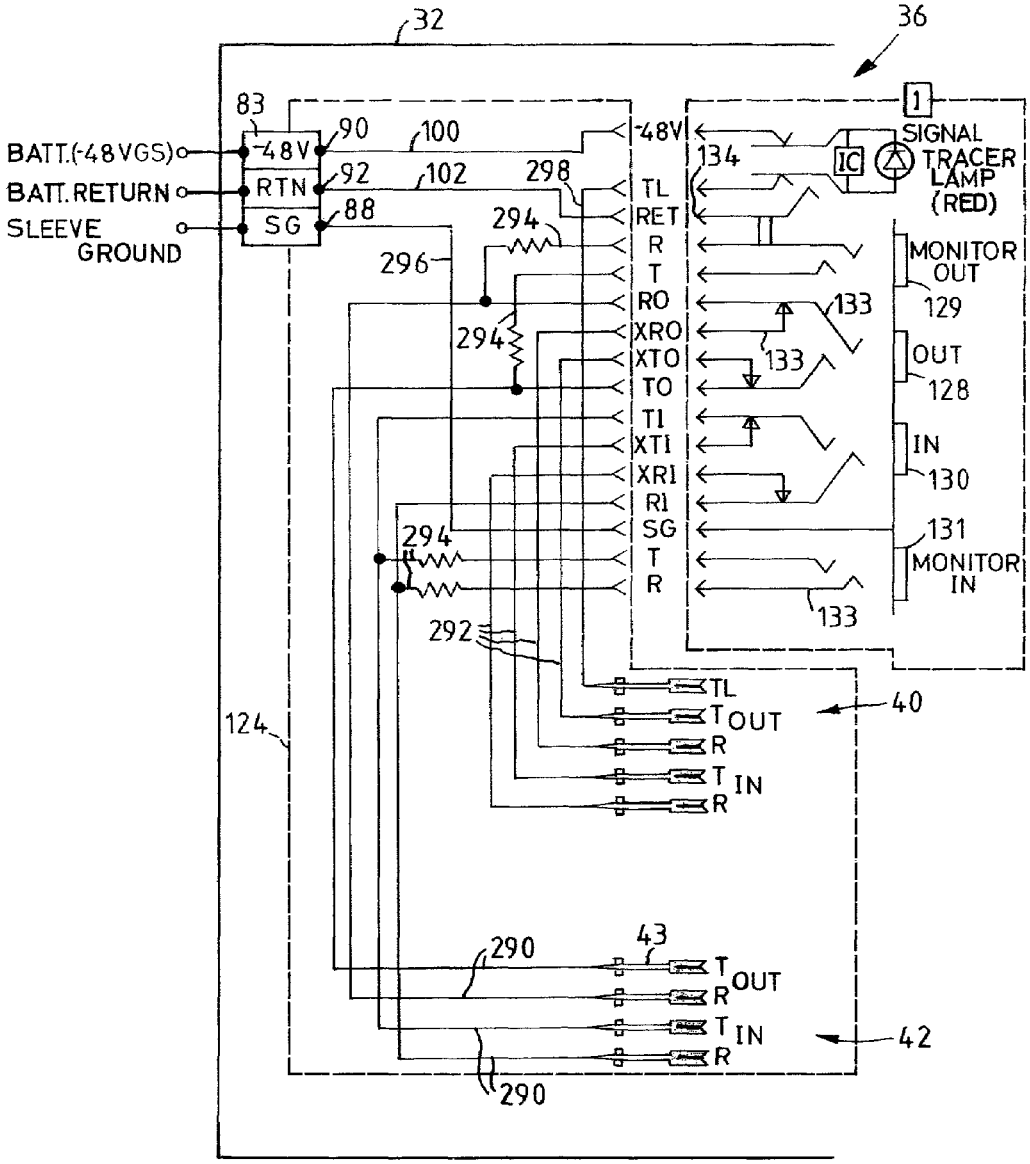
Figure 9B:
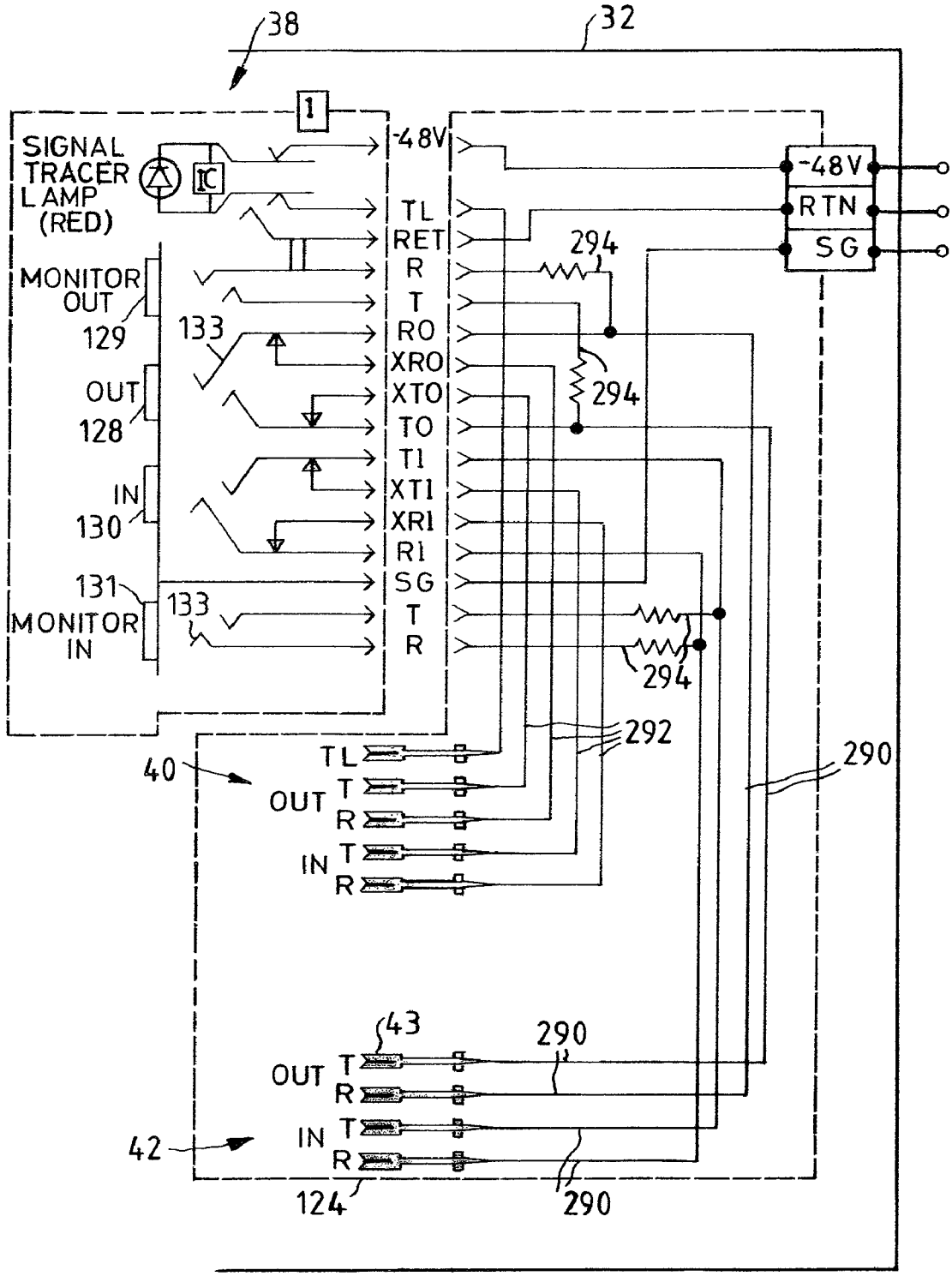
Figure 10:
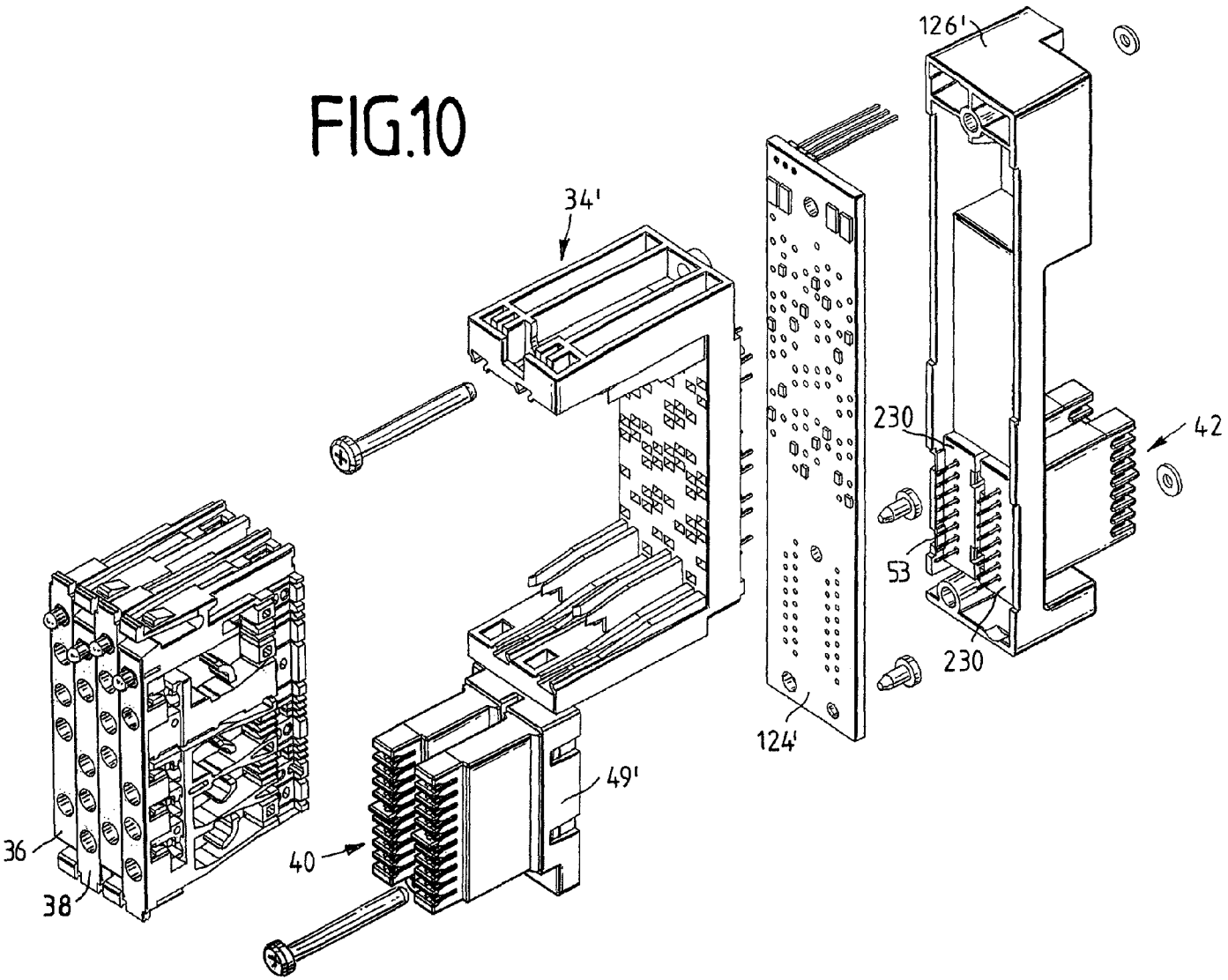
Figure 11:
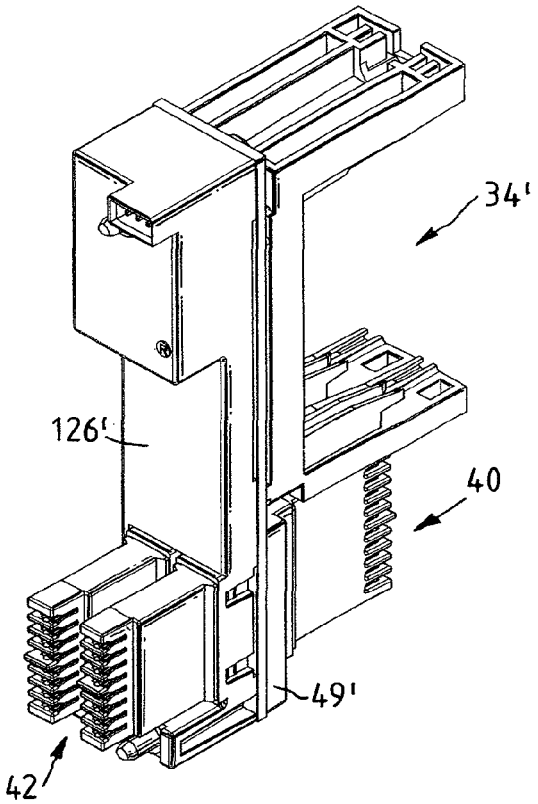
Figure 12:
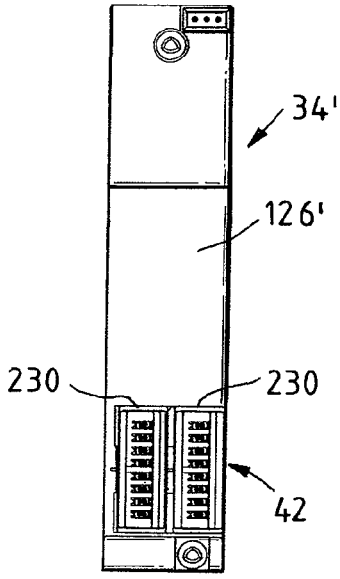
Figure 13:
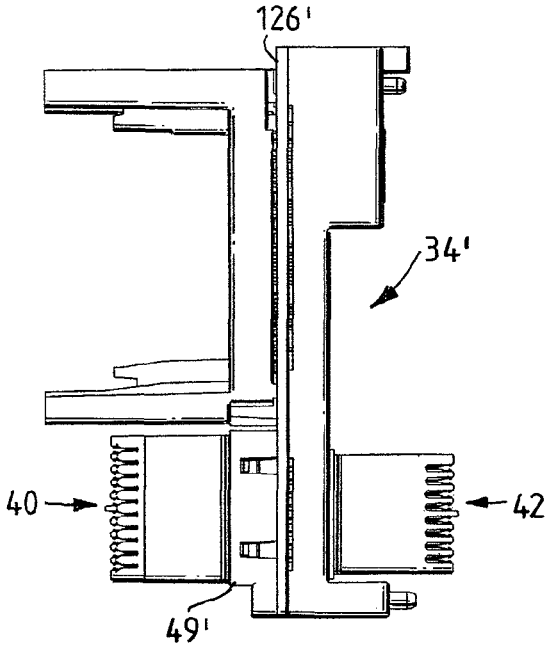
Figure 14:
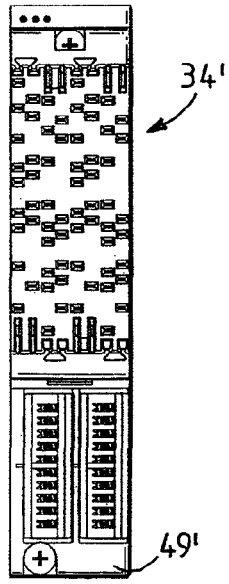
Figure 15A:
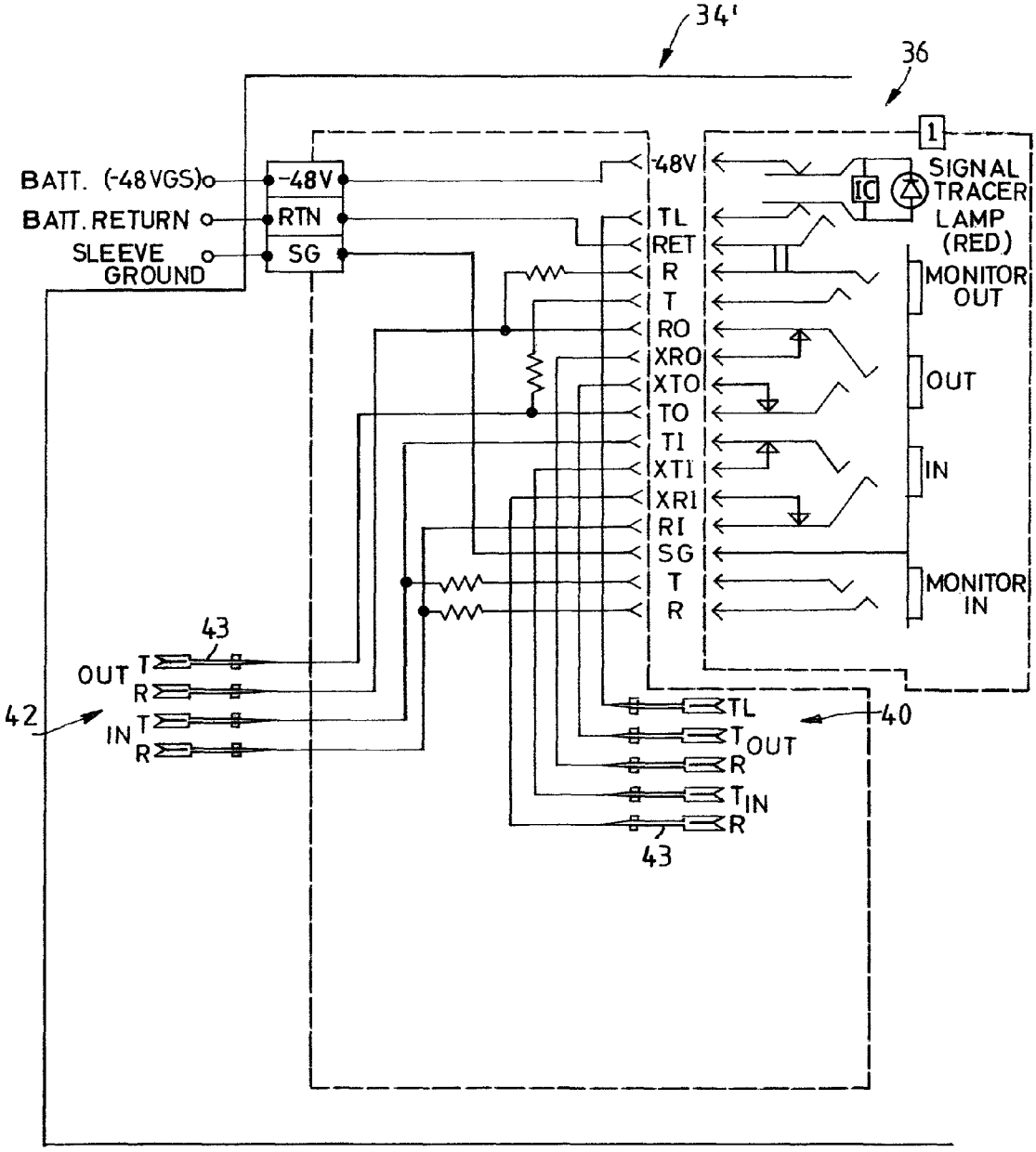
Figure 15B:
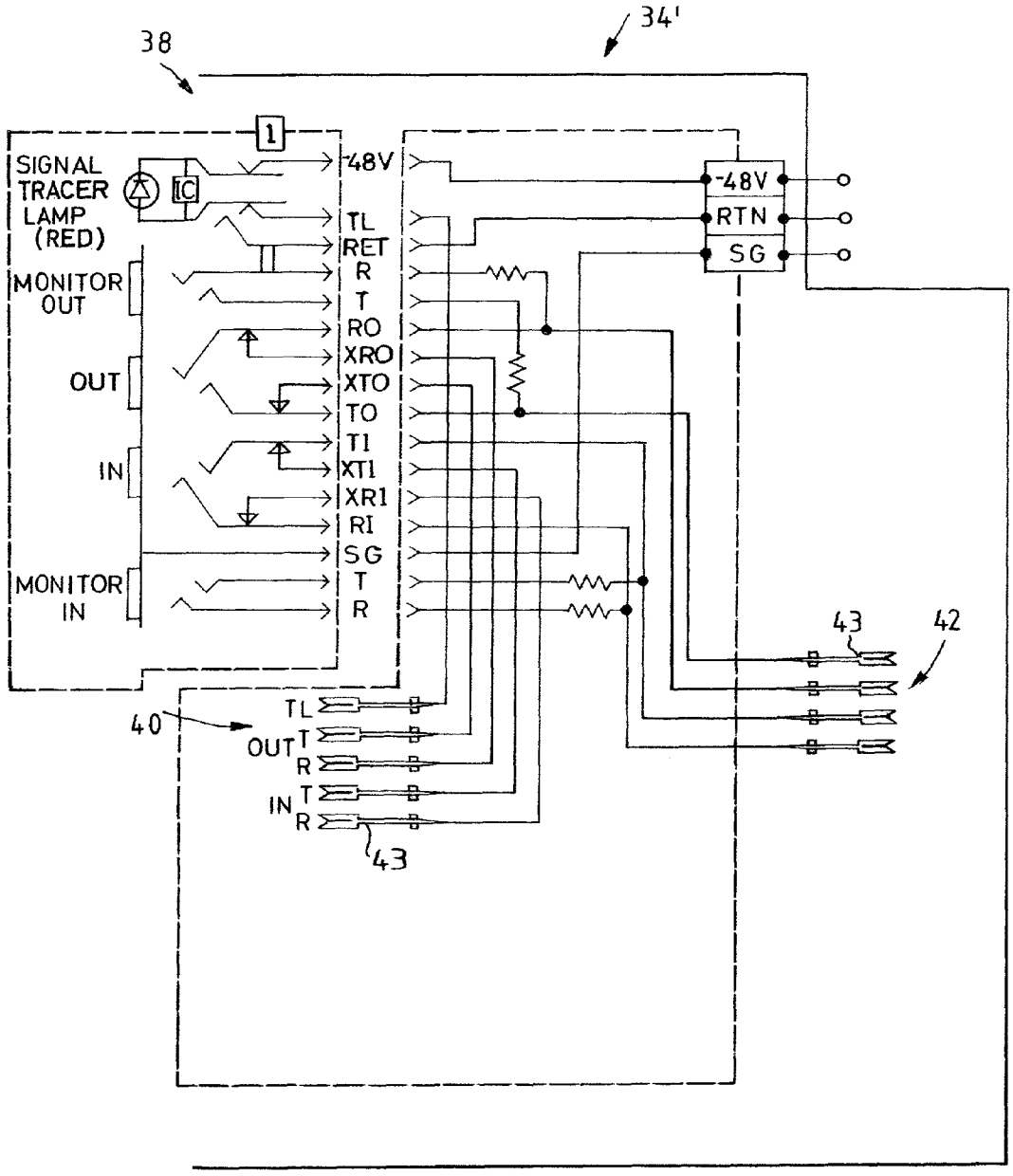

FIG. 2*a* is an enlarged perspective view of a contact element of an insulation displacement plug-in connector for the DSX module shown in FIG. 2;

FIG. 2*b* is a partial plan view of two insulation displacement plug-in connectors, FIG. 2*c* is a cross section along the section line B-B, FIG. 2*d* is a cross section along the section line C-C, FIG. 3 is a rear perspective view of the DSX module of FIG. 2 with the DSX sockets removed;

FIG. 4 is a rear view of the DSX module shown in FIG. 2;

FIG. 5 is a side view of the DSX module shown in FIG. 2 with the DSX sockets removed;

FIG. 6 is a front view of the DSX module shown in FIG. 2 with the DSX sockets and the insulation displacement plug-in connectors removed;

FIG. 7 is a front view of an insulation displacement plug-in connector for the DSX module shown in FIG. 2;

FIG. 8 is a rear view of the insulation displacement plug-in connector shown in FIG. 7;

FIGS. 9A and 9B are circuit schematics of odd and even DSX socket inserts of the DSX module shown in FIG. 2;

FIG. 10 is a front perspective view of a DSX module in a second embodiment;

FIG. 11 is a rear perspective view of the DSX module of FIG. 10 with the DSX sockets removed;

FIG. 12 is a rear view of the DSX module shown in FIG. 10;

FIG. 13 is a side view of the DSX module shown in FIG. 10 with the DSX sockets removed;

FIG. 14 is a front view of the DSX module shown in FIG. 10 with the DSX sockets removed; and FIGS. 15A and 15B are circuit schematics of odd and even DSX socket inserts of the DSX module shown in FIG. 10.

FIG. 2 illustrates a first embodiment of a DSX module 34 in perspective.

The DSX module 34 includes a socket receptacle 35 configured to hold a plurality of sockets 36, 38 (e.g., two odd sockets 36 and two even sockets 38). The DSX module 34 has a front accessible cross-connect field 40 and a front accessible device termination field 42 (i.e., IN/OUT). The termination fields 40, 42 are each formed by two insulation displacement plug-in connectors 41 and each include fields (e.g., arrays, rows, columns, or other groups) of contact elements 43 for terminating wires to the DSX module 34. The contact elements 43 are supported within housings 45 at the termination fields 40, 42. The housings 45 are mounted to a front cover piece 49 secured to the front side of the DSX module 34. The front cover piece 49 covers a front side of a printed circuit board 124 that provides electrical connections between the sockets 36 and 38 and the insulation displacement plug-in connectors 41 of the termination fields 40, 42. A dielectric back cover piece 126 covers a back side of the printed circuit board 124.

When the DSX module 34 is assembled, fasteners 127 are used to couple the socket receptacle 35 and the front cover piece 49 together with the back cover piece 126. As assembled, the printed circuit board 124 is positioned between the front structure formed by the socket receptacle 35 and the front cover piece 49, and the back structure formed by the back cover piece 126. The fasteners 127' can also be used to further secure the printed circuit board 124 to the back cover piece 126.

It will be appreciated that the DSX module 34 can preferably be held in a chassis (a chassis 32 is schematically shown in FIGS. 9A and 9B). To conform to conventional international standards, the chassis can have a length of about 48 cm. This embodiment can house, for example, 16 DSX modules. Alternatively, in accordance with standard United States specifications, the chassis could be configured to have a length of about 58.5 cm. This embodiment can house, for example, 21 DSX modules. Of course, other sizes of chassis and other numbers of DSX modules could also be used. An exemplary chassis is disclosed in U.S. Pat. No. 6,840,815, which is hereby incorporated by reference in its entirety.

a. Socket Receptacle

The socket receptacle 35 of each DSX module 34 can preferably removably hold the odd and even DSX sockets 36 and 38. For example, the sockets 36 and 38 can be retained within the socket receptacle 35 by resilient latches 37 as described in U.S. Pat. No. 6,116,961. By flexing the latches 37, the sockets 36 and 38 can be manually removed from the socket receptacle 35. When the sockets 36 and 38 are removed from the socket receptacle 35, the sockets 36 and 38 are electrically disconnected from the printed circuit board 124. While the DSX module 34 is shown as a "four-pack" (i.e., a module including four sockets), it will be appreciated that alternative modules can include socket receptacles sized to receive more or fewer than four sockets.

The socket receptacle 35 of each DSX module 34 includes a plurality of further sockets 136 (shown in FIG. 2) for providing electrical interfaces with the sockets 36, 38 when the sockets 36, 38 are mounted in the socket receptacles 35. The sockets 136 hold electrical contacts 137 having pins electrically connected directly to the printed circuit board 124.

b. DSX Sockets

Referring to FIG. 2, each of the sockets 36, 38 includes a front face defining an OUT Port 128, a MONITOR-OUT Port 129, an IN Port 130 and a MONITOR-IN Port 131. The ports 128-131 are sized to receive tip-and-ring plugs. The sockets 36, 38 also define LED ports 132 for receiving signal tracer lamps. The sockets 36, 38 further include electrical contacts 133 (see FIGS. 9A and 9B) each associated with the ports 128-132. The contacts 133 include tails 134 that project rearwardly from each of the sockets 36, 38. When the sockets 36, 38 are inserted within the socket receptacle 35, the tails 134 of the contacts 133 slide within the sockets 136 of the DSX module 34 to provide electrical connections between the printed circuit board 124 and the sockets 36, 38. When the sockets 36, 38 are removed from the socket receptacle 35, the sockets 36, 38 are electrically disconnected from the circuit board 124.

Referring to FIGS. 9A and 9B, the electrical contacts of the sockets 36, 38 include voltage contacts -48V, signal tracer lamp contacts TL and return contacts RET associated with the LED circuits. The electrical contacts also include tip springs T and ring springs R corresponding to the MONITOR-IN and MONITOR-OUT ports. The electrical contacts further include tip-in contacts TI, ring-in contacts RI, cross-connect tip-in contacts XT1 and cross-connect ring-in contacts XRI corresponding to the IN ports. The electrical contacts further include tip-out contacts TO, ring-out contacts RO, cross-connect tip-out contacts XTO and cross-connect ring-out contacts XRO corresponding to the OUT ports. The contacts operate in the same manner as described in U.S. Pat. No. 6,116,961 that was previously incorporated by reference. The contacts TI, RI, XTI and XRI and the contacts TO, RO, XTO and XRO cooperate to define normally "closed" switches.

c. Printed Circuit Board and Back Piece

As shown in FIG. 2, the printed circuit board 124 is positioned directly behind the socket receptacle 35, the cross-connect termination field 40 and the device termination field 42. The printed circuit board 124 includes a first part 124*a* associated with the back side of the socket receptacle 35. The first part 124*a* includes a plurality of plated through-holes 139 that receive the pins of the electrical contacts 137 to provide a direct electrical connection between the printed circuit board 124 and the electrical contacts 137.

The printed circuit board 124 also includes a second part 124*b* positioned behind and co-extensive with the cross-connect termination field 40. The second part 124*b* includes a plurality of plated through-holes 146 that hold pin contacts 53 of the contact elements 43 of the insulation displacement plug-in connectors 41 mounted at the cross-connect termination field 40. This provides an electrical connection between the circuit board 124 and the insulation displacement plug-in connectors 41 of the cross-connect termination field 40.

The printed circuit board 124 further includes a third part 124*c* positioned behind and co-extensive with the device termination field 42. The third part 124*c* includes a plurality of plated through-holes 148 that hold pin contacts 53 of the contact elements 43 of the insulation displacement plug-in connectors 41 mounted at the device termination field 42 to provide an electrical connection between the printed circuit board 124 and the insulation displacement plug-in connectors 41.

The back cover piece 126 of the DSX module 34 is preferably made of a dielectric material and is sized to cover the back side of the printed circuit board 124. The cover piece 126 defines a plug 82 adapted to electrically connect with a receptacle 83 (see schematic in FIGS. 9A and 9B) of the chassis 32 when the DSX module 34 is mounted in the chassis 32. The plugs 82 include sleeve ground pins 88, power/voltage pins 90 and power return pins 92 that are respectively connected to the chassis sleeve/shield ground, the chassis power, and the chassis power return (see FIGS. 9A and 9B). The pins 88, 90 and 92 are connected directly to the printed circuit board 124 (e.g., the pins extend within plated through-holes 93 defined by the printed circuit board 124).

Referring still to FIGS. 9A and 9B, the printed circuit board 124 includes tracings 290 that electrically connect the contact elements 43 of the insulation displacement plug-in connector 41 of the device termination field 42 to socket parts associated with the contacts TI, RI, TO and RO of the sockets 36, 38. The printed circuit board 124 also includes tracings 292 that provide electrical connections between the contact elements 43 of the insulation displacement plug-in connectors 41 of the cross-connect termination field 40 and socket parts associated with the contacts XTI, RTI, XTO and XRO of the sockets 36, 38. Additionally, the printed circuit board 124 includes tracings 294 for electrically connecting tracings 290 to the socket parts associated with the contacts of the MONITOR ports of the sockets 36, 38. Further, the printed circuit board 124 includes tracings 296 for connecting the sleeve ground pins 88 to socket parts associated with the sleeve ground contacts SG of the sockets 36, 38; tracings 298 for connecting the signal tracer lamp IDCs of the cross-connect termination 40 to socket parts associated with the signal tracer lamp contacts TL of the sockets 36, 38; tracings 100 for connecting power/voltage pins 90 to socket parts associated with the voltage contacts—48V of the sockets 36, 38; and tracings 102 for connecting power return pins 92 to socket parts associated with the return contacts RET of the sockets 36, 38.

d. Contact Elements

The contact element 43 is made of a conductive material such as a metal material. In certain embodiments, the contact elements 43 can be stamped from sheet metal. As shown in FIG. 2A, each contact element 43 includes a pair of insulation displacement blades 51 which form the actual insulation displacement contact 54. A contact slot 52 is formed between the insulation displacement blades 51. The insulation displacement blades 51 are configured such that when an insulated cable wire is inserted in the contact slot 52 between the insulation displacement blades 51, the insulation displacement blades 51 cut through the insulation of the cable wire and into the conductive core of the wire to provide an electrical connection between the conductive core of the cable wire and the contact element 43. A pin contact 53 is arranged at the opposite end of the insulation displacement contact 54 and is used for connection of the contact element 43 to the printed circuit board 124. A rectangular guide element 56 is arranged underneath the insulation displacement contact 54, with the guide element 56 being broader than the insulation displacement contact 54. Furthermore, the contact element 43 has a first extension 55 and a second extension 58, which electrically connect the insulation displacement contact 54 to the pin contact 53. The extensions 55, 58 offset the insulation displacement contacts 54 from the printed circuit board 124, in order to make it easier to access the insulation displacement plug-in connector 41 using a connecting tool, which is not illustrated. In certain examplary embodiments, the extensions 55, 58 have offset lengths OL (i.e., the lengths which correspond to the distance through which the insulation displacement contacts 54 will be offset from the printed circuit board) of at least 1 cm or lengths in the range of from 1-3 centimeters. The second extension 58 is used to guide the pin contact 53 through the cover piece 49, 49'. Two curved elements 57 are arranged at the side between the first extension 55 and the second extension 58 and on the one hand support the contact element 43 on the cover piece 49, 49', with the curved elements 57 themselves being supported in the housing 45, so that the position of the contact element 43 is fixed. The two curved elements 57 are in this case curved in opposite senses with respect to one another.

e. IDC Housings

Referring to FIGS. 2, 2*b-d*, 5, 7 and 8, the housings 45 have generally rectangular shapes and include base ends or undersides 61 and wire termination ends or upper sides 63. The upper side 63 defines slots 65 (see FIG. 7) for holding wires to be connected. The slots are aligned along parallel lines L so that the wires extend across the width of the housing 45 when connected. FIG. 7 shows the upper side 63 of the insulation displacement plug-in connector 41. The housing 45 has clamping webs 64 between which slots 65 are formed for the wires to be connected. The insulation displacement blades 51 of the insulation displacement contacts 54 are arranged at an angle of 450 to the slots 65. The contact elements 43 are inserted into the housing 45 from the underside 61, with FIGS. 7 and 8 illustrating the state in which the contact elements 43 have been inserted. This shows the guide elements 56 and the curved element 57. The guide elements 56 are in this case located in a groove 70, with one outer edge of the guide element in each case being located in a different groove 70. As can be seen particularly well in FIG. 2*c*, the groove 70 extends from the underside of the housing 45 into the area where the insulation displacement contact 54 is located. Slots 71 are incorporated in the walls which bound the groove 70, and the curved elements 57 are located in these slots 71. The length of the slots corresponds to the length of the curved elements 57, so that they strike against an edge 72 in the housing 45. Furthermore, latching tabs 69 (see FIG. 8) can be seen, by means of which the insulation displacement plug-in connectors can be latched to the receptacles.

The insulation displacement plug-in connectors 41 at the cross-connect termination field 40 are the same as those at the device termination field 42 except each housing 45 at the device termination field 42 has two fewer contact elements 43. More contact elements 43 are provided at the cross-connect termination field 40 to accommodate terminating wires for connecting signal tracer light circuitry used to trace the cross-connections.

f. Front Cover Piece

Referring to FIGS. 2, 5 and 6, the front cover piece 49 can have a one-piece construction made of a dielectric material such as plastic. In the depicted embodiment, the cover piece 49 includes a platform 220 and four support structures 222 that project forwardly from the platform 220. Each of the support structures 222 includes two side walls 224, upper and lower walls 225, 226, and a back wall 227. The walls 224-227 define rectangular receptacles 230 sized to hold the underside 61 of the housings 45. The side walls 224 define openings 232 for receiving the latching tabs 69 of the housings 45 to provide snap-fit connections that retain the housings 45 within the receptacles. The back walls 227 define openings 234 for receiving the pin contacts 53 of the contact elements 43 when the housings 45 are secured within the receptacles 230. The openings 234 defined by the back walls 227 of the receptacles located at the cross-connect termination field 40 preferably align with the plated through-holes 146 located at the second part 124*b* of the printed circuit board 124. The openings 234 defined by the back walls 227 of the receptacles located at the cross-connect termination field 40 preferably align with the plated through-holes 148 located at the second part 124*b* of the printed circuit board 124.

II. Use of DSX System

It will be appreciated that the DSX system 30 operates in the same manner as a conventional DSX system. The (IN/OUT blocks) device termination field 42 allows the sockets 36, 38 to be connected to pieces of the digital device. The cross-connect termination field 40 allows the sockets 36, 38 to be connected to one another by semi-permanent jumpers. The sockets 36, 38 provide normally-connected connections between the digital device connected to the device termination field 42 and the cross-connect termination field 40. By inserting plugs in the MONITOR ports of the sockets 36, 38, signals passing through the sockets 36, 38 can be monitored without interrupting the signals. The signal tracer lamp circuits allow the cross-connected connections being monitored to be traced as is described in U.S. Pat. No. 6,116,961. Plugs can be inserted in the IN or OUT ports of the sockets 36, 38 for testing or diagnostic purposes, or for re-routing signals to different pieces of the digital device.

III. Alternative Embodiment

FIGS. 10-15B show another DSX module 34' having features that are examples of inventive aspects in accordance with the principles of the present disclosure. Many of the components of the DSX module 34' are identical to components of the DSX module 34. These identical components have been assigned identical reference numbers.

The DSX module 34' has the same basic components as the DSX module 34, except the device termination field 42 has been moved to the rear of the module. To accommodate this change, the DSX module 34' includes a shortened printed circuit board 124' having a greater density of plated through-holes for connecting the insulation displacement plug-in connectors 41 of the termination fields 40, 42 to the printed circuit board 124'. Also, the DSX module 34' includes a back cover piece 126' which has been shortened and modified to include receptacles 230 that receive the insulation displacement plug-in connectors 41 which define the device termination field 42 located at the rear of the module 34'. Moreover, the DSX module 34' includes a front cover piece 49' that has been shortened and modified to eliminate the lower set of receptacles 230.

While the disclosed insulation displacement mounting configuration has been shown used in combination with a DSX module, it will be appreciated that the configuration can be used on any type of DSX system (modular or nonmodular). Moreover, the insulation displacement mounting configuration is also applicable to any type of printed-circuit-board-mounted insulation displacement application.

The termination fields 40, 42 have each been illustrated as insulation displacement plug-in connectors 41. Irrespective of whether the termination fields 40, 42 are both accessible from the front or the device termination field 42 is accessible from the rear, mixed arrangements can also be used. For example, it is possible for one termination field to be in the form of an insulation-displacement plug-in connector 41 and the other termination field to be in the form of a coaxial connector, for example a Balun, M4, 1.0/2.3, 1.6/5-6, SMB or Type 43 coaxial connector or an RJ connector, in particular an RJ 45 connector (shielded or unshielded). In this case, the cross-connect termination field 40 is preferably in the form of an insulation displacement plug-in connector 41, and the device termination field 42 is in the form of a coaxial or RJ connector. In addition, other connector types are also possible, such as D-Sub.

Particularly in the case of the embodiment having the cross-connect termination field 40 at the front and the device termination field 42 at the rear, the insulation displacement plug-in connector 41 may also be replaced by a wire-wrap connector, which is then preferably used on the cross-connect termination field 40 while, in contrast, the device termination field 42 is formed, for example with a coaxial or RJ connector, with reference being made apart from this to the previous statements relating to the DSX module with an insulation displacement plug-in connector.

LIST OF REFERENCES SYMBOLS

10*a*, 10*b*, 10*c* DSX sockets
12 Digital switch
14*a*, 14*b* Office repeater
16 Out termination pins
18 In termination pins
19 Cross-connect field
20, 21, 23 Patch cord
30 DSX system
32 Chassis
34, 34' DSX module
35 Socket receptacle
36, 38 Sockets
37 Latch
40 Cross-connect termination field
41 Insulation displacement plug-in connector
42 Device termination field
43 Contact element
45 Housing
49, 49' Cover piece
51 Insulation displacement blade
53 Pin contact
52 Contact slot
54 Insulation displacement contact
55 First extensions
56 Guide element
57 Curved elements
58 Second extensions
61 Underside
62 Upper side
64 Clamping webs
65 Slots
69 Latching tabs
70 Groove
71 Slot
72 Edge
82 Plug
83 Receptacle
88 Sleeve ground pins
90 Power/voltage pins
92 Power return pins
93 Holes
102 Tracing
124, 124' Printed circuit board
124*a* First part
124*b* Second part
124*c* Third part
126, 126' Rearward rotating piece/back piece
127, 127' Fastener
128 Out port
129 Monitor out port
130 IN port
131 Monitor-in port
132 LED terminations
133 Electrical contacts
134 End pieces
136 Sockets
137 Electrical contacts
139 Holes
146, 148 Holes
220 Platform
222 Support structures
224 Side walls
225, 226 Walls
227 Back walls
230 Rectangular receptacles
232, 234 Openings
100, 290, 292, 294, 296, 298 Tracings
TI, RI, TO, RO Contacts

We claim:

1. An insulation displacement plug-in connector for telecommunications and data technology, comprising:

a housing defining a plurality of grooves, each groove extending from an underside of the housing to an upper side of the housing, the housing also defining a plurality of slots at the underside of the housing, each slot being incorporated into one of the grooves; and a plurality of contact elements, the contact elements each having an insulation displacement contact for connection of wires and a pin contact for making contact with a printed circuit board, the insulation displacement contact and the pin contact of each contact element being positioned within one of the grooves of the housing;

wherein at least one extension is arranged between the insulation displacement contact and the pin contact of each contact element, and wherein two support elements are arranged at an end of the extension associated with the pin contact of each contact element, the two support elements curving in opposite directions away from the extension, and the two support elements being configured to fit within the slots defined at the underside of the housing wherein the housing has slots for holding the wires to be connected, with the insulation displacement contact of each contact element being aligned at an angle of 45° to one of the slots.

2. The insulation displacement plug-in connector as claimed in claim 1, wherein the length of the slots corresponds to the length of the curved support elements.

3. The insulation displacement plug-in connector as claimed in claim 1, wherein a further extension is arranged between the curved elements and the pin contact.

4. The insulation displacement plug-in connector as claimed in claim 1, wherein latching tabs are arranged on an exterior of the housing.

5. The insulation displacement plug-in connector as claimed in claim 1, wherein a guide element is arranged on the underside of each insulation displacement contact.

6. The insulation displacement plug-in connector as claimed in claim 5, wherein the guide element of each contact element is broader than the respective insulation displacement contact.

7. The insulation displacement plug-in connector as claimed in claim 5, wherein the grooves of the housing are configured to receive the guide elements.

8. A device for telecommunications and data technology, comprising:

at least one printed circuit board, at least one cover piece arranged on one side of the printed circuit board, the cover piece defining through-openings, a plug-in connector including a housing and a plurality of contact elements, each contact element having a pin contact and an insulation displacement contact, the pin contact of each contact element making contact with the printed circuit board through one of the openings in the cover piece, wherein the contact elements each include at least one extension arranged between the insulation displacement contact and the pin contact of each contact element, and wherein two support elements are arranged at an end of the extension associated with the pin contact, the two support elements curving in opposite directions away from the extension;

wherein the housing has slots for holding the wires to be connected, with the insulation displacement contact of each contact element being aligned at an angle of 45° to one of the slots.

9. The device as claimed in claim 8, wherein the device is in the form of a digital signal distributor.

10. The device as claimed in claim 8, wherein the device comprises a multiplicity of sockets which each have a multiplicity of normally closed contacts, a cross-connect termination field and a device termination field, the printed circuit board providing electrical connections between the normally closed contacts and the cross-connect termination field and the device termination field, wherein at least one of the cross-connect termination field and the device termination field is formed by the contact elements.

11. The device as claimed in claim 8, wherein the cover piece has at least one receptacle, which is integrally connected to the cover piece, with the plug-in connector being latched to the receptacle.

12. The device as claimed in claim 11, wherein the receptacle has walls which define a cube having an open top.

13. A digital signal distributor, comprising:

a multiplicity of sockets, which each have a multiplicity of normally closed contacts, a cross-connect termination field, a device termination field, a printed circuit board providing electrical connection between the normally closed contacts and the cross-connect termination field and the device termination field, and at least one of the cross-connect termination field and the device termination field comprising a plug-in connector including a housing and a plurality of contact elements, the housing defining a plurality of grooves, each groove extending from an underside of the housing to an upper side of the housing, the housing also defining a plurality of slots at the underside of the housing, each slot being incorporated into one of the grooves, the contact elements each having an insulation displacement contact for connections of wires and a pin contact for making contact with the printed circuit board, the insulation displacement contact and the pin contact of each contact element being positioned within one of the grooves of the housing, wherein at least one extension is arranged between the insulation displacement contact and the pin contact of each contact element, and the pin contacts of the insulation displacement plug-in connector being connected to the printed circuit board, and wherein two support elements are arranged at an end of the extension associated with the pin contact of each contact element, the two support elements curving in opposite directions away from the extension, and the two support elements being configured to fit within the slots defined at the underside of the housing wherein the housing has slots for holding the wires to be connected, with the insulation displacement contact of each contact element being aligned at an angle of 45° to one of the slots.

* * * * *

UNITED STATES PATENT AND TRADEMARK OFFICE

CERTIFICATE OF CORRECTION

PATENT NO. : 7,815,439 B2
APPLICATION NO. : 11/996177
DATED : October 19, 2010
INVENTOR(S) : Klein et al.

It is certified that error appears in the above-identified patent and that said Letters Patent is hereby corrected as shown below:

Title Pg, Item (87) PCT Pub. Date: "Feb. 25, 2007" should read --Jan. 25, 2007--

Col. 2, line 12: "DSX sockets 10*a* and lob. Likewise," should read --DSX sockets 10*a* and 10*b*. Likewise,--

Col. 7, line 29: "angle of 450 to the slots" should read --angle of 45° to the slots--

Col. 10, line 48, claim 1: "housing wherein the housing has" should read --housing; wherein the housing has--

Col. 12, line 36, claim 13: "underside of the housing wherein the housing" should read --underside of the housing; wherein the housing--

Signed and Sealed this
Thirteenth Day of September, 2011

David J. Kappos

David J. Kappos
*Director of the United States Patent and Trademark Office*